United States Patent [19]

Chao

[11] Patent Number: 4,856,255

[45] Date of Patent: Aug. 15, 1989

[54] RETRACTABLE TOOL-FREE WINDOW FRAME

[76] Inventor: Hsun-Wei Chao, 11 Fl., No. 703, Chung-Cheng Rd., Shih-Lin District, Taipei, Taiwan

[21] Appl. No.: 291,281

[22] Filed: Dec. 28, 1988

[51] Int. Cl.[4] ..... E04B 1/60

[52] U.S. Cl. ..... 52/769

[58] Field of Search ..... 52/402, 476, 769, 773

[56] References Cited

U.S. PATENT DOCUMENTS

| | | | |
|---|---|---|---|
| 2,166,361 | 7/1939 | Lowry | 52/769 |
| 3,090,085 | 5/1963 | Brown | 52/769 X |
| 3,212,225 | 9/1965 | Neal | 52/769 |

*Primary Examiner*—David A. Scherbel

*Assistant Examiner*—Jerrold D. Johnson

*Attorney, Agent, or Firm*—Morton J. Rosenberg

[57] ABSTRACT

An H-shaped main frame with a blade slidably retained in its upper part. The main frame is divided into an upper and a lower compartment by a partition plate which extends between the two vertical side walls of the H-shaped main frame. A part of the blade projects out of the main frame to form a section of window frame. Posts on the lower part of the blade are spring-loaded to make the blade normally project out from the upper compartment of the main frame. Retention rings are fixed to each of the posts to prevent them from extending out of the main frame. Alignment rails on the blade are slidably retained by corresponding alignment channels on the main frame.

1 Claim, 3 Drawing Sheets

RETRACTABLE TOOL-FREE WINDOW FRAME

BACKGROUND OF THE INVENTION

This invention relates to window frames and in particular relates to a window frame which is retractable without the use of tools for the insertion or replacement of a glass plate.

Conventionally, window panes are often retained by inserting the pane onto a permanent outer frame or window sash and then using some other permanent fixing means on the inner side of the pane so as to permanently fix the window. For example, in colonial style windows, the panes are set on a wooden latticework frame and are retained when the inner pieces of the latticework are nailed or screwed onto the rest of the latticework so as to retain the pane between the inner and outer latticework. Of course, this requires the use of tools and nails or screws which are of a suitable size and quality for use therein. As it is inconvenient to have to locate and use such equipment, and since an extra amount of caution is necessary when nailing or screwing because of the fragile nature of glass, a more convenient and inherently less delicate method of glass pane insertion or replacement is desirable.

Another common type of window is the sliding window which is set in place by the manufacturer, usually in some type of metal framework. However, if the window pane therein is broken, it is difficult or impossible for an ordinary user to replace the pane by himself.

Other types of windows, while they might be different from the above windows in styling or use, often have one or more of the above-discussed problems.

It is the purpose of this present invention, therefore, to mitigate and/or obviate the abovementioned drawbacks in the manner set forth in the detailed description of the preferred embodiment.

SUMMARY OF THE INVENTION

A primary objective of this invention is to provide a window frame which does not require the use of tools when installing or replacing window pane therein.

Another objective of this invention is to provide a window frame which is retractable.

A further objective of this invention is to provide a window frame which is inherently less painstaking to install than conventional window frames.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
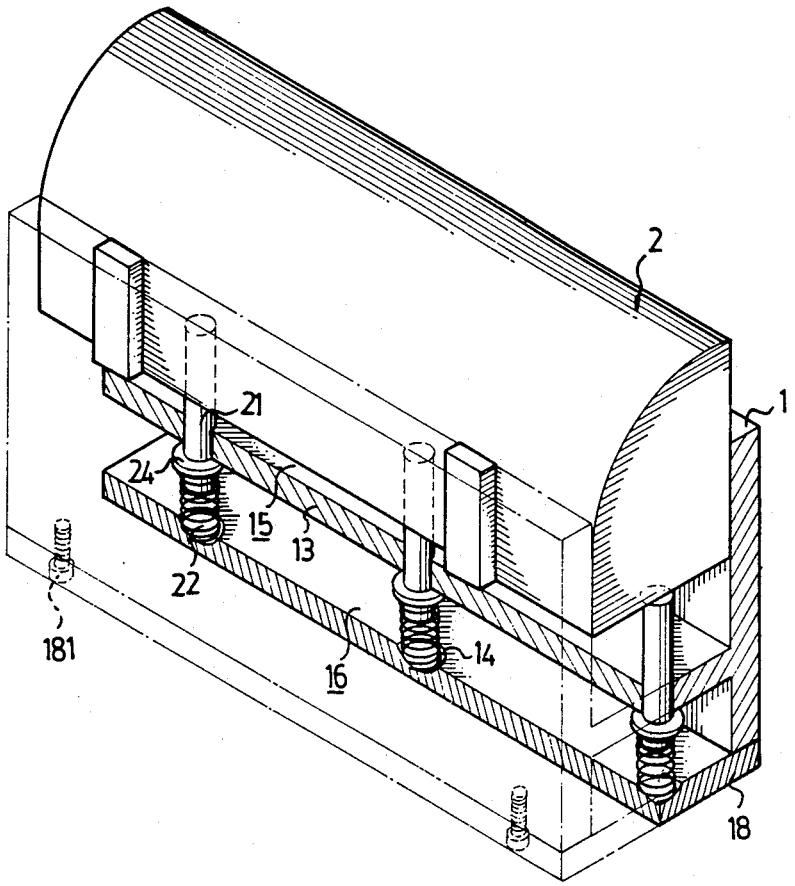
FIG. 1 is a cutaway view of a retractable tool-free window frame in accordance with the present invention, with the inner structure being shown in hidden lines.

Referring to FIG. 1, it can be seen that the present invention essentially consists of a main frame 1 into which a glass-retention blade 2 is slidably received. The main frame 1 is substantially H-shaped with a partition plate 13 laterally extending between and connecting to the two vertical side walls thereof. A lower partition plate is fixed at the lower end of the main frame 1. The partition plate 13 divides the main frame 1 into an upper compartment 15 which has an upper top side and a lower compartment 16 which is closed. The partition plate 13 also has holes 17 (see FIG. 2) set and evenly spaced along a central lengthwise axis thereof. The main frame 1 has a plurality of circular recesses 14 on an upper surface of a lower plate 18 which are respectively vertically in line with the holes 17 in the partition plate 13. The blade 2 is substantially square on the lower surface and two side surfaces front and rear side surfaces) and the lower surface is perpendicular to the side surfaces. The top surface of the blade 2 should be designed to be asthetically pleasing and for purposes of illustration in this specification is shown as curving gradually upwards with a positive but continuously decreasing slope from the front side vertical surface to the rear side vertical surface. The blade is slightly smaller in width than the distance between the two vertical walls of the main frame 1 so that the blade 2 is slidably received in said upper compartment 15.

Figure 2:
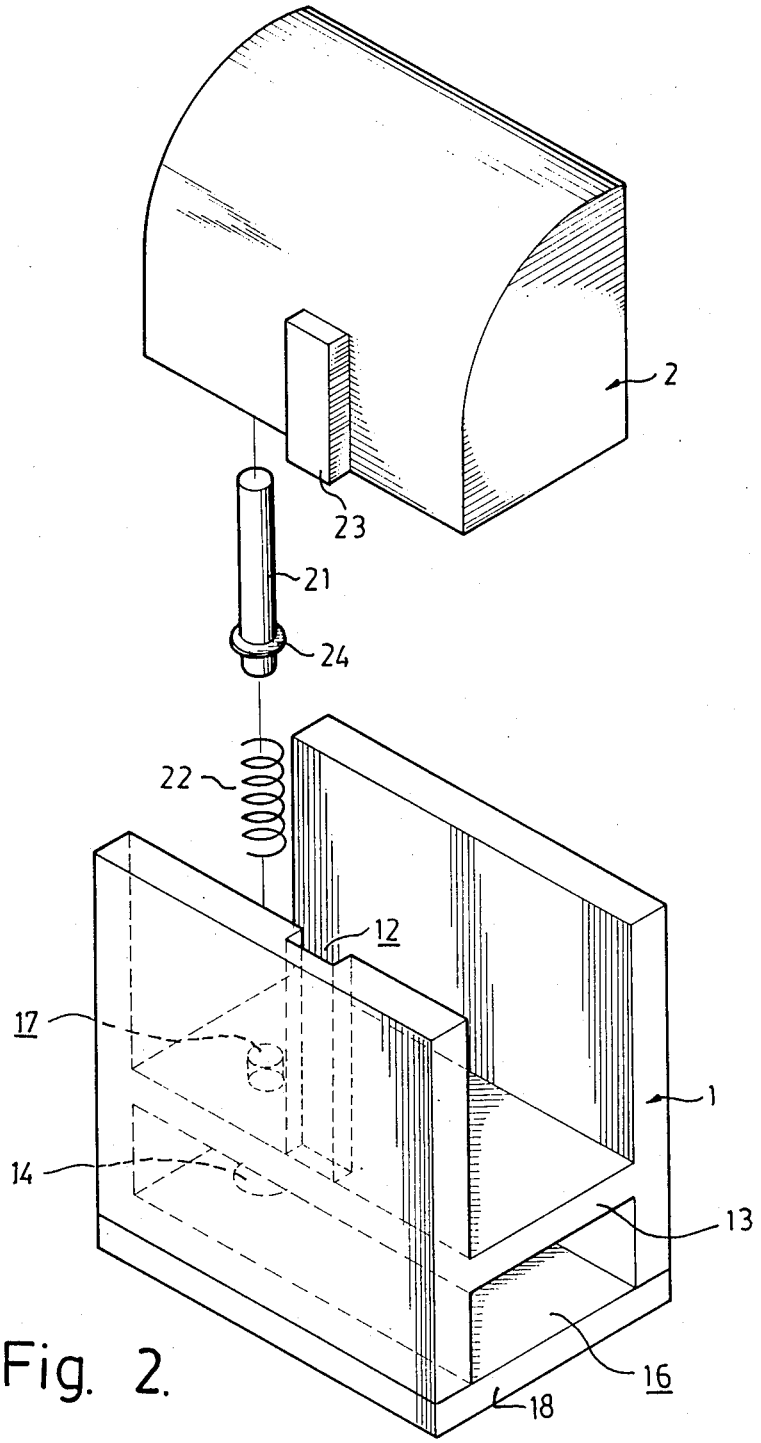
FIG. 2 is an exploded view of the retractable tool-free window frame of FIG. 1.

Further referring to FIG. 2, it can be seen that the front side of the blade 2 has a plurality of alignment rails 23 protruding therefrom. Each alignment rail 23 is substantially rectangular in shape and is slidably retained in a rectangularly shaped alignment channel 12, which is on the inner side of the front side wall of the main frame 1 and which vertically extends from the top surface of said main frame 1 to said lower surface of the lower compartment 16. The blade 2 also has a plurality of extension posts 21 protruding straight downwards from the bottom surface thereof. The extension posts 21 are slidably received by the holes 17 and are loaded by respective springs 22 so that the blade 2 normally projects out of the top of the upper compartment 15, as seen in FIG. 1, so as to spring load the blade 2. The springs 22 are each retained by a retention ring 24, which are respectively fixed on lower ends of each extension post 21, and by a respective circular recess 14 on the other end thereof. The annular retention rings 24 are respectively fixed on the lower portion of the extension posts 21 (i.e., in the lower compartment 16 of the main frame 1), The retention rings 24 prevent the upper part of the extension post 21 (and hence the blade 2) from projecting too far out of the upper compartment 15. In other words, the retention ring 24 sets the distance that the rear side wall projects above the main frame 1.

Figure 3:
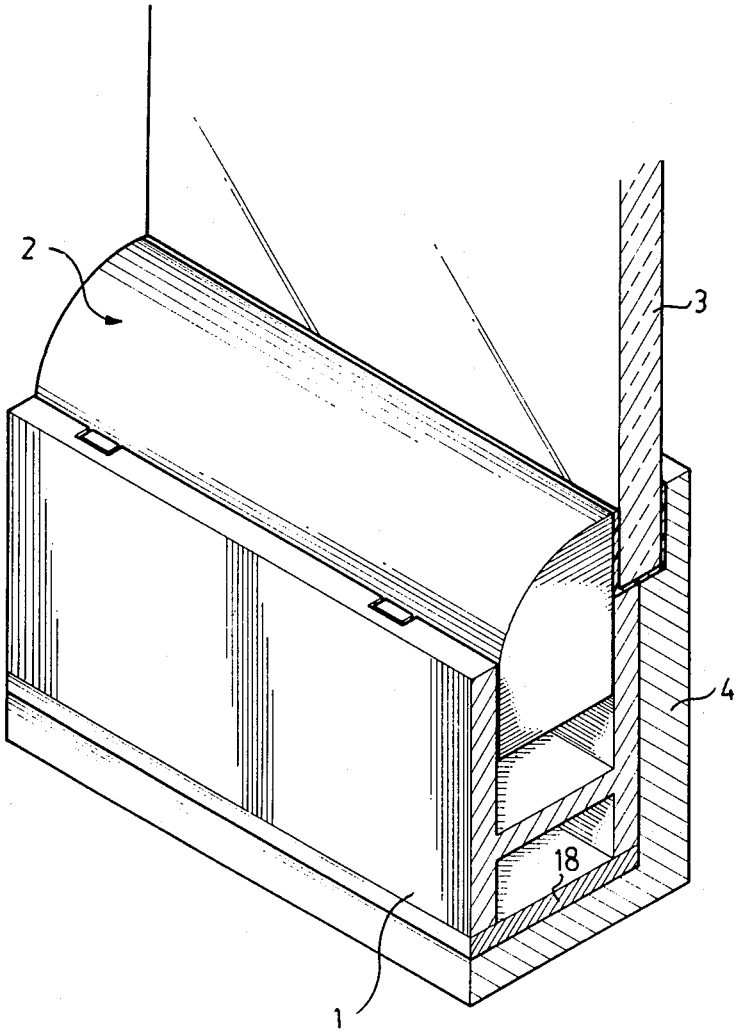
FIG. 3 is working view of a retractable tool-free window frame in accordance with the present invention, used in conjunction with a window frame.

FIG. 3 shows one possible working view of the present invention. In this view, the window's base frame 4 is essentially L-shaped, so that a sheet of plate glass 3 is retained between the blade 2 and the vertical wall of the base frame 4. Of course, a soft pad 5 or the like could be used to further stabilize and protect the plate glass 3. To remove the plate glass 3, the blade 2 is simply pushed down until the entire curved (top) surface of the blade 2 is below the plate glass 3. In this position, there is nothing to retain the front side of the plate glass 3 and accordingly the glass can be taken out by the user.

Because the blade 2 is pushed down by hand, no tools are required. To replace the plate glass 3, simply reverse the above procedure.

It is also noted that two very suitable materials for the manufacture of the tool-free window frame of the present invention would be acrylic or hard plastic. Such materials are inexpensive and easy to cut into sections or lengths as might be desired.

When manufacturing, the extension posts 21 are glued on the bottom surface of the blade 2. Optionally, threaded bores could be made in the lower surface of the blade 2 and the posts 21 could be threaded so as to be engageable in the bores. The posts 21 are then fitted through respective holes 17 on the partition plate 13. Next, the respective retention rings 24 are fitted on each of the lower portion of the posts 21. The retention rings 24 can be frictionally fitted (force fitted), glued, or heat welded onto the post 21 so as to secure it thereon. Finally, the lower partition plate 18 is glued or screwed to the lower portion of the main frame 1.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A retractable tool-free window frame comprising:

(A) a substantially H-shaped main frame (1); said main frame (1) including a partition plate (13) set laterally between two side walls and a lower partition plate (18) fixed at a lower end of said H-shaped main frame (1); said partition plate (13) having a plurality of holes (17) thereon which are evenly spaced along a lengthwise central axis thereof; said partition plate (13) dividing said main frame (1) into an upper compartment (15) and a lower compartment (16); said lower partition plate (18) having a plurality of circular recesses (14) on an upper surface thereof; said recesses (14) being respectively vertically in-line with said holes (17); a plurality of rectangular alignment channels (12) vertically extending from a top surface of said side walls to an upper surface of the partition plate (13);

(B) a spring-loaded glass retention blade (2); said blade (2) having a lower surface, a top surface and a front side surface and a rear side surface, said rear surface being perpendicular to said lower surface; said blade (2) being slidably received by said upper compartment (15); said top surface of said blade (2) having a positive slope which continuously decreases from the front side surface to the rear side surface; and a plurality of extension posts (21) protruding straight downwards from a bottom surface of said blade (2), said extension posts (21) being respectively slidably received by said holes (17); said extension posts (21) each having a respective retention ring (24) fixed on a lower portion thereof to prevent said blade (2) from projecting too far out of the upper compartment (15); a plurality of rectangular alignment rails (23) extending vertically along and projecting out from said front side surface; said alignment rails (23) respectively being slidably received by said rectangular alignment channels (12).

* * * * *